US006460718B1

(12) United States Patent
Vogel

(10) Patent No.: US 6,460,718 B1
(45) **Date of Patent: *Oct. 8, 2002**

(54) CONTAINER WITH A THREADED CAP HAVING A STEPPED SEALING RING WITH A PLURALITY OF NARROW SEALING SURFACES

(75) Inventor: William C. Vogel, Milwaukee, WI (US)

(73) Assignee: Gateway Plastics Incorporated, Mequon, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/663,874

(22) Filed: Sep. 15, 2000

Related U.S. Application Data

(63) Continuation-in-part of application No. 09/374,976, filed on Aug. 16, 1999, now Pat. No. 6,250,517, which is a continuation of application No. 08/959,399, filed on Oct. 28, 1997, now Pat. No. 5,971,231.

(51) Int. Cl.[7] ..... B65D 51/18

(52) U.S. Cl. ..... 220/254.2; 220/254.7; 220/837; 222/565; 222/556; 222/480; 215/341; 215/343; 215/344; 215/235; 215/237; 215/DIG. 1; 206/508

(58) Field of Search ..... 215/341, 343, 215/344, 346, 319, 235, 237, DIG. 1; 220/378, 254, 259, 837, 380, 287, 254.1–254.3, 254.5, 254.7, 256.1, 259.1, 259.2, 259.3; 222/565, 480, 556; 206/508

(56) References Cited

U.S. PATENT DOCUMENTS 785,116 A * 3/1905 Perry
893,469 A * 7/1908 Essmuller
2,276,635 A * 3/1942 Weber
3,117,701 A * 1/1964 Stull ..... 222/153.14
3,203,571 A * 8/1965 Plunkett ..... 215/344
3,217,921 A * 11/1965 Frehse
3,428,208 A * 2/1969 Kosar ..... 215/341
3,606,074 A * 9/1971 Hayes
3,788,510 A * 1/1974 Collins
3,888,373 A * 6/1975 Gach et al.
4,693,399 A * 9/1987 Hickman et al.
4,878,589 A * 11/1989 Webster et al. ..... 215/344
4,881,668 A * 11/1989 Kitterman et al.
4,936,494 A * 6/1990 Weidman
4,955,504 A * 9/1990 Lesscher
4,971,213 A * 11/1990 Ishinabe et al.
5,048,730 A * 9/1991 Forsyth et al.
5,083,671 A * 1/1992 Hayes
5,085,331 A * 2/1992 Groya et al.
5,129,533 A * 7/1992 Loffler
5,339,993 A * 8/1994 Groya et al.
5,499,736 A * 3/1996 Kohl ..... 215/237
5,799,838 A * 9/1998 Miller
5,971,231 A * 10/1999 Samz et al.
6,202,872 B1 * 3/2001 Smeyak et al.
6,250,517 B1 * 6/2001 Samz et al.

FOREIGN PATENT DOCUMENTS

FR 1153553 * 3/1958 ..... 215/344
GB 2120219 * 11/1983 ..... 215/344

* cited by examiner

*Primary Examiner*—Nathan J. Newhouse
*Assistant Examiner*—Robin A Hylton
(74) *Attorney, Agent, or Firm*—Nilles & Nilles, S.C.

(57) ABSTRACT

A plastic cap has one or more hinged flaps that cover openings in the cap, as well as a stepped sealing ring against which the top of a plastic bottle seals. The sealing ring is stepped, much like the rows of seats in a circular stadium. This stepped arrangement permits the cap to be used with many different bottle rim diameters and automatically corrects any ovality of the bottle rim by forcing it to flex into a more circular shape as it engages the steps of the stepped ring.

16 Claims, 7 Drawing Sheets

CONTAINER WITH A THREADED CAP HAVING A STEPPED SEALING RING WITH A PLURALITY OF NARROW SEALING SURFACES

This application is a continuation-in-part of U.S. application Ser. No. 09/374,976, filed Aug. 16, 1999, now U.S. Pat. No. 6,250,517, which is a continuation of application Ser. No. 08/959,399, filed Oct. 28, 1997, now U.S. Pat. No. 5,971,231.

FIELD OF THE INVENTION

This invention generally relates to hand-held plastic containers for storing and dispensing particulate matter. More particularly, it relates to such containers with a cover having a plurality of flaps for enclosing, respectively, a plurality of openings in the cover. More particularly, it relates to containers for foodstuffs having a shaker opening with a plurality of holes and/or a spooning opening with a large opening adapted to receive a common household spoon.

BACKGROUND OF THE INVENTION

Plastic caps and receptacles for the disposable container industry suffer from certain incompatibilities. Generally speaking, they are considered interchangeable, since they have standard threads and standard major diameters. For this reason, one can expect a nominal "63 mm" cap to handily screw onto a "63 mm" receptacle. Beyond this, however, one cannot be assured of compatibility. Commercial receptacles or bottles typically have recessed shoulders adjacent to their open threaded ends to receive the threaded skirt of the cap. The goal is to screw a cap with an outer circular diameter onto a bottle with the same unrecessed outer diameter, thereby providing a cylindrical container with a constant outer diameter over its entire height. As a result, when one screws a random cap onto a random bottle, the skirt of the cap may interfere with the unrecessed portion of the bottle before the cap is screwed down. This will prevent the cap from being screwed completely down, thereby preventing the sealing surfaces of the cap from completely engaging the sealing surfaces of the bottle.

In addition to this incompatibility, the diameter and width of the sealing surfaces of the bottle and cap are often different, even when they have the same nominal thread pitch and major diameter. If a manufacturer wishes to make a cap (or bottle) that can be used with the greatest range of bottles (or caps) by other manufacturers, he is compelled to make as wide a sealing surface as possible. Unfortunately, this requires additional plastic.

There is another problem when manufacturing caps with wide sealing flanges: the propensity of the bottle top to buckle when screwed down too tightly. A wide flange permits force to be applied evenly to the top of bottles with warped sealing surfaces. These bottles have sealing surfaces at their mouths that are not truly circular, but are oval. By screwing a cap down firmly onto the bottle, such as with an automatic capping machine, the oval top begins to buckle, with some portions of the bottle bending inward, and some portions of the bottle bending outward. U.S. Pat. No. 4,693,399, which issued to Hickman (Sep. 15, 1987) purported to solve the ovality problem by providing the cap with a wide, flat sealing surface that was wide enough to accommodate a warped, oval-topped bottle. By providing a wide, flat surface against which the bottle could seal, the top of the bottle could be quite oval, yet there would still be sufficiently wide, flat surface against which it could seal. Unfortunately, this arrangement merely accommodated the out-of-roundness of a warped bottle. The tops of the bottles remained warped. This was an effective solution for hand-tightened caps, but was of quite limited value for machine-attached and tightened caps. Machines for attaching caps to bottles operate at high speeds. It is quite difficult to adjust them to provide a constant tightening torque. As a result the torque applied to seal a cap on bottle will vary significantly in a single production run. Given this wide range of tightening torques, the wide flange of the '399 patent can actual cause bottles to buckle during capping.

As the cap is tightened, the oval rim of the bottle slides against the wide, flat sealing flange, reducing friction between the rim and the wide sealing flange, making it easier to move axially inward or outward, toward or away from the central axis of the bottle. As a result of this reduced friction, the oval rim of the bottle tends to increase in ovality as the bottle is over-tightened until it either disengages from the threads or the bottle collapses.

What is needed is an improved cap that can accommodate a wide range of bottle mouth diameters. What is also needed is a cap that can correct (and not accommodate) bottles with warped oval mouths and sealing surfaces. It is an object of this invention to provide such a cap.

SUMMARY OF THE INVENTION

In accordance with a first embodiment of the invention, a circular plastic cap having a longitudinal axis is disclosed, the cap including an end cover, at least one flap integrally formed with the end cover, a cylindrical skirt integrally coupled to the end cover at one end and having a second open end configured to receive the mouth of a receptacle, and a circular sealing ring disposed inside the skirt and adjacent to the end cover, the sealing ring having a plurality of planar sealing surfaces, axially spaced apart, such that each sealing surface has a greater diameter the closer that sealing ring is to the open end of the skirt. Each sealing surface may have an axial width substantially equal to or less than an average thickness of the cap. The sealing ring may include a plurality of substantially right cylindrical surfaces coaxial with the cap disposed between adjacent sealing surfaces.

Each right cylindrical surface may have a greater diameter the preceding right cylindrical surface as one approaches the open end of the skirt. The sealing ring may be fixed to the end cover. The sealing ring may or may not be fixed to the skirt.

In accordance with a second embodiment of the invention, a container is disclosed, the container including a receptacle including a right cylindrical sidewall having an externally threaded upper end and a lower end, a bottom integrally formed with the sidewall and enclosing the lower end of the sidewall, wherein the upper end of the receptacle defines a mouth having a mouth sealing surface, and a circular plastic cap having a longitudinal axis, wherein the cap further comprises an end cover, at least one flap integrally formed with the end cover, a cylindrical skirt integrally coupled to the end cover at one end and having a second open end configured to receive the mouth of a receptacle, and a circular sealing ring disposed inside the skirt and adjacent to the end cover, the sealing ring having a plurality of planar sealing surfaces, axially spaced apart, such that each sealing surface has a greater diameter the closer that sealing ring is to the open end of the skirt, wherein one of the plurality of sealing surfaces is engaged with the mouth sealing surface and at least one of the plurality of sealing surfaces is not engaged with the mouth sealing surface. The end cover and the at least one flap may be configured to provide the cap with a substantially flat planar end surface. The at least one flap may be recessed into and flush with the end cover. The cap may further comprise a second flap, wherein the second flap is integrally formed with the end cover. The second flap may be recessed into and flush with the end cover. Each sealing surface may have an axial width substantially equal to or less than an average thickness of the cap. The sealing ring may include a plurality of substantially right cylindrical surfaces coaxial with the cap disposed between adjacent sealing surfaces. Each right cylindrical surface may have a greater diameter than a preceding right cylindrical surface as one approaches the open end of the skirt. The sealing ring may be fixed to the end cover. The sealing ring may not be fixed to the skirt.

In accordance with a third embodiment of the invention, a method of attaching an sealing a cap to a bottle is disclosed, wherein the cap comprises an end cover; a cylindrical skirt integrally coupled to the end cover at one end and having a second open end configured to receive the mouth of a receptacle, and a circular sealing ring disposed inside the skirt and adjacent to the end cover, the sealing ring having a plurality of planar sealing surfaces, axially spaced apart, such that each sealing surface has a greater diameter the closer that sealing ring is to the open end of the skirt, and wherein the bottle comprises a right cylindrical sidewall having an externally threaded upper end and a lower end, a bottom integrally formed with the sidewall and enclosing the lower end of the sidewall, wherein the upper end of the receptacle defines a mouth having a mouth sealing surface, wherein the method includes gripping the bottle in an automatic capping machine, gripping the cap in an automatic capping machine, rotating the cap clockwise with respect to the bottle while advancing the cap toward the bottle, engaging the external threads on the bottle to the internal threads on the cap, rotating the cap until the mouth sealing surface engages a first of the plurality of sealing surfaces, further rotating the cap until the mouth sealing surface engages a second of the plurality of sealing surfaces, wherein the second of the plurality of sealing surfaces has a smaller diameter than the first of the plurality of sealing surfaces, and sealing the container against the second of the plurality of sealing surfaces. The step of further rotating the cap may include the step of guiding at least a portion of the mouth sealing surface inwardly toward the axis of the cap. The step of further rotating the cap may include the step of deforming the mouth sealing surface into a more circular shape.

DETAILED DESCRIPTION OF THE INVENTION

Figure 1:
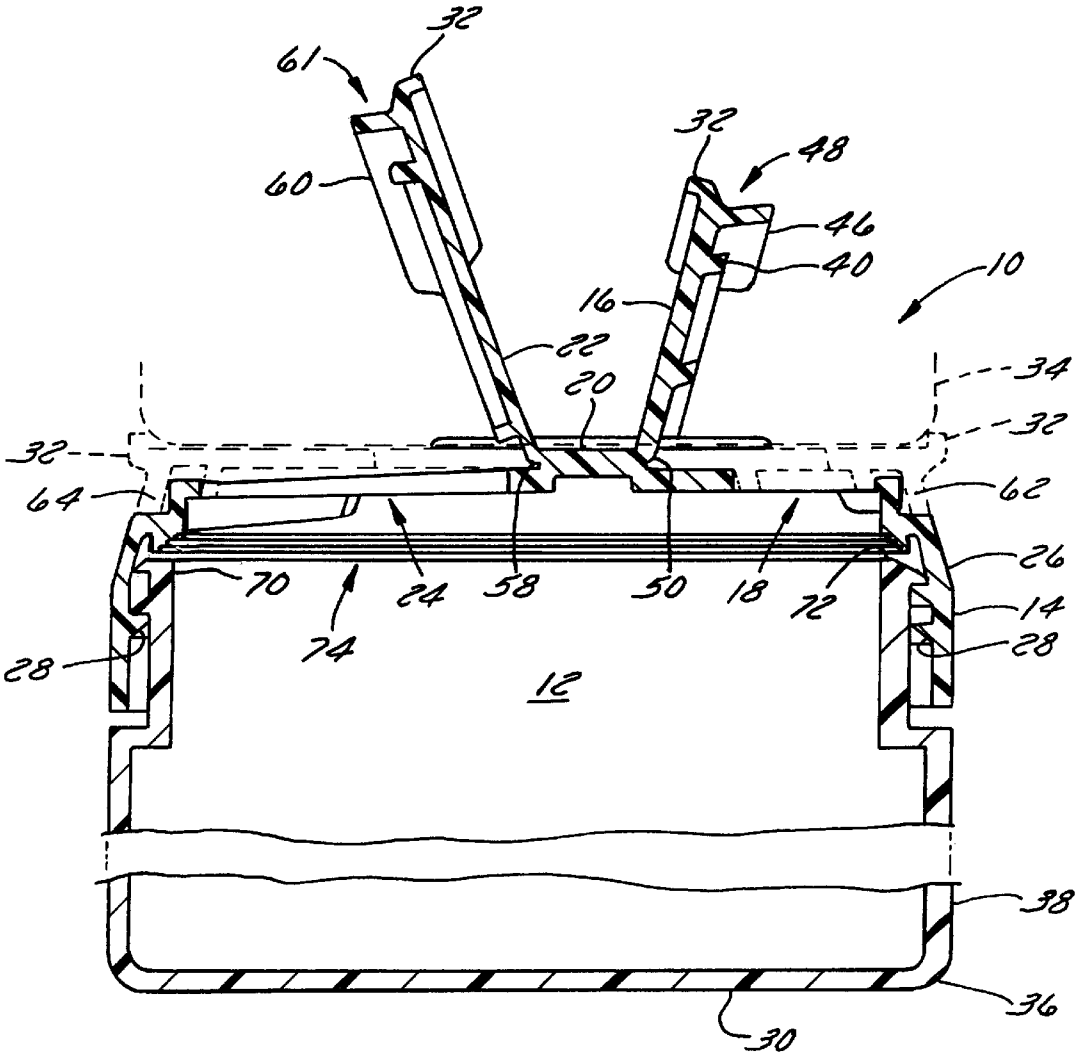
FIG. 1 is a cross-sectional side view of a container including a cover and receptacle in accordance with the current invention showing the flaps in an open position and as dashed lines in a closed position.

Before explaining at least one embodiment of the invention in detail it is to be understood that the invention is not limited in its application to the details of construction in the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

FIG. 1 illustrates a container 10 having a receptacle 12 and a cap or cover 14. Cover 14 includes a shaker flap 16, called a shaker flap because it covers (when closed) shaker openings 18 disposed in planar top portion 20 of the cover. Cover 14 also includes a spooning flap 22 that similarly covers a larger spooning opening 24 also disposed in top portion 20.

Figure 2:
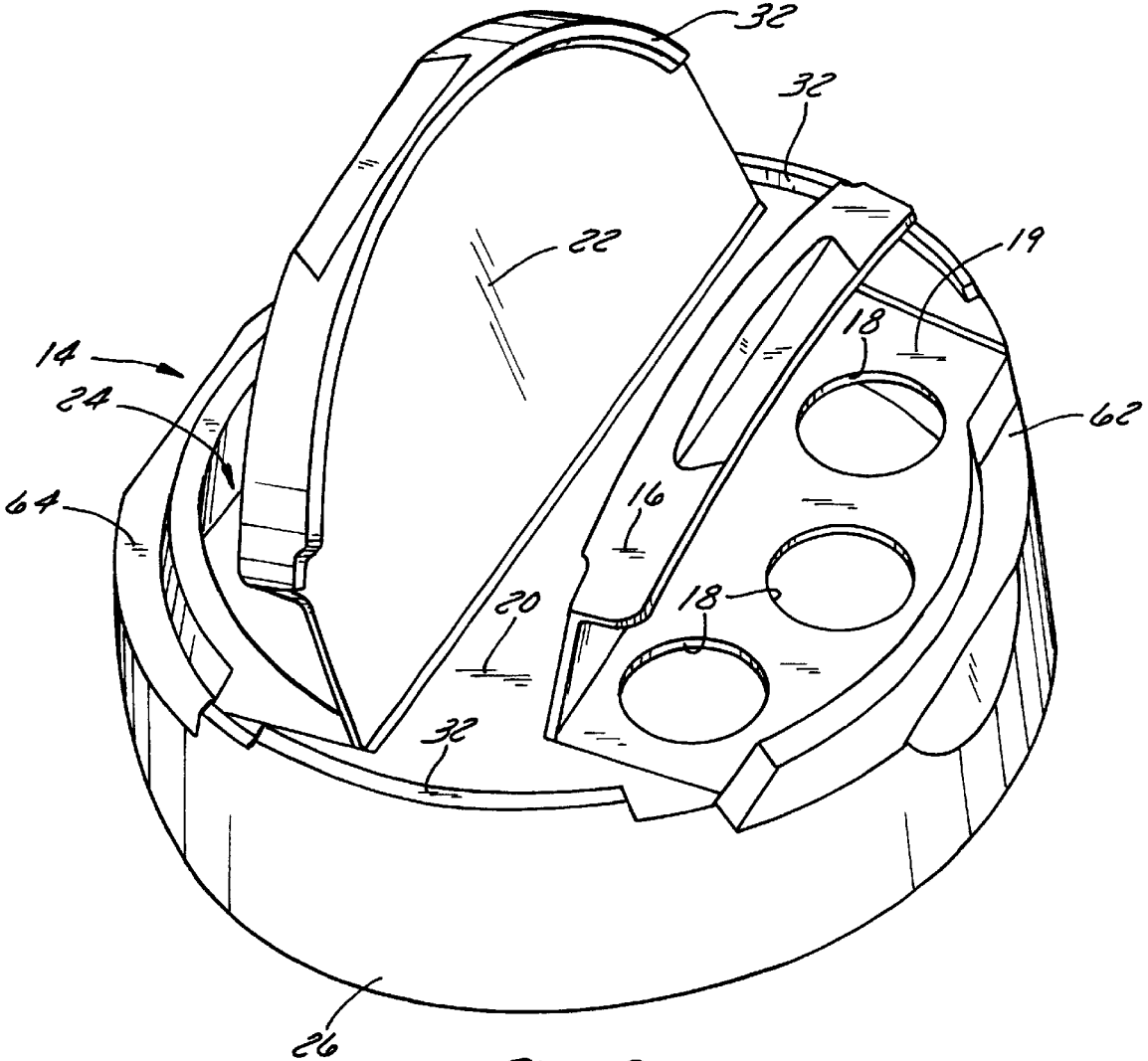
FIG. 2 is an orthogonal view of the cover of FIG. 1, showing the flaps in an open position.

The cover as best seen in FIG. 2, is in the form of a substantially cylindrical portion 26, and top portion 20 which is coupled to an upper end of cylindrical portion 26 to enclose cylindrical portion 26. Referring to FIG. 1, which shows a portion of the cover in cross-section with the receptacle attached, threads 28 are provided on the inner surface of cylindrical portion 26 for coupling cylindrical portion 26 to the outside of the top of receptacle 12. As seen in FIG. 1, mating threads are disposed on an outer indented top portion of receptacle 12 to engage threads 28. Alternatively, cylindrical portion 26 may be equipped with an inner detent or a raised ring to allow it to be snap connected to the top portion of receptacle 12. Referring to FIG. 2, an elongate recess 19 is provided in which shaker flap 16 will fit when flap 16 is in a closed position, to provide a substantially flat upper surface of top portion 20 on which a similar container can be stacked.

Referring back to FIG. 1, receptacle 12 includes a substantially planar bottom portion 30 that is adapted to engage a lip 32 of cover 14. There is a significant advantage to this feature: since the bottom portion 30 is adapted to engage lip 32, then a plurality of containers identical to the one pictured in FIGS. 1 and 2 can be stacked one atop the other, lip 32 serving to orient the bottom of the next higher container and so keep the containers in proper alignment when stacked. In FIG. 1, two identical containers are shown in this stacked arrangement, the bottom of the upper container being shown as dashed line 34 engaging rim 32 when the flaps of the lower container are in a closed position (shown in FIG. 1 as dashed lines when in their closed positions). It can be seen that bottom portion 30 (and hence identical bottom portion 34) and top portion 20 with lip 32 are adapted to engage one another. Lip 32 is disposed at an outer edge of cover 14 to engage a recess 36 at the junction of bottom 30 and wall 38 of receptacle 12. By disposing both lip 32 and recess 36 to engage each other near the outer periphery of the container, study has shown that the containers are more easily stacked, and when stacked tend to self-center. A portion of lip 32 is preferably disposed on shaker flap 16, spooning flap 22 as well as on the non-hinged sides of top portion 20 as can be best seen in FIG. 4. Each of these portions is preferably disposed at an outer edge of cover 14 and have substantially the same diameter. Other designs, provide orienting means disposed more closely to the center of the container, such as by providing an indentation at or near the center of the receptacle bottom that engages with an upwardly extending protrusion located near the center of the cover on which it is stacked, are more difficult to stack accurately and also tend to tip more easily. In addition, it is harder to hold tolerances on an inner indentation than an outer indentation as shown in FIG. 1. These designs have the added disadvantage of requiring an internal recess to be formed in the center of the receptacle bottom, requiring additional machining to manufacture.

Referring to FIGS. 1 and 2, a plurality of oval shaker openings 18, preferably substantially circular as shown here, are provided to allow foodstuffs within the container to be shaken out when shaker flap 16 is opened. These openings are preferably arranged not along a straight line, but along an arc. On the underside of shaker flap 16 is an arcuate flange 40 adapted to engage and seal central shaker opening 18. This flange extends for about 30 degrees around the periphery of its mating opening 18 when in a closed position. Flange 40 engages the inner surface of opening 18 and holds the shaker flap closed.

Figure 3:
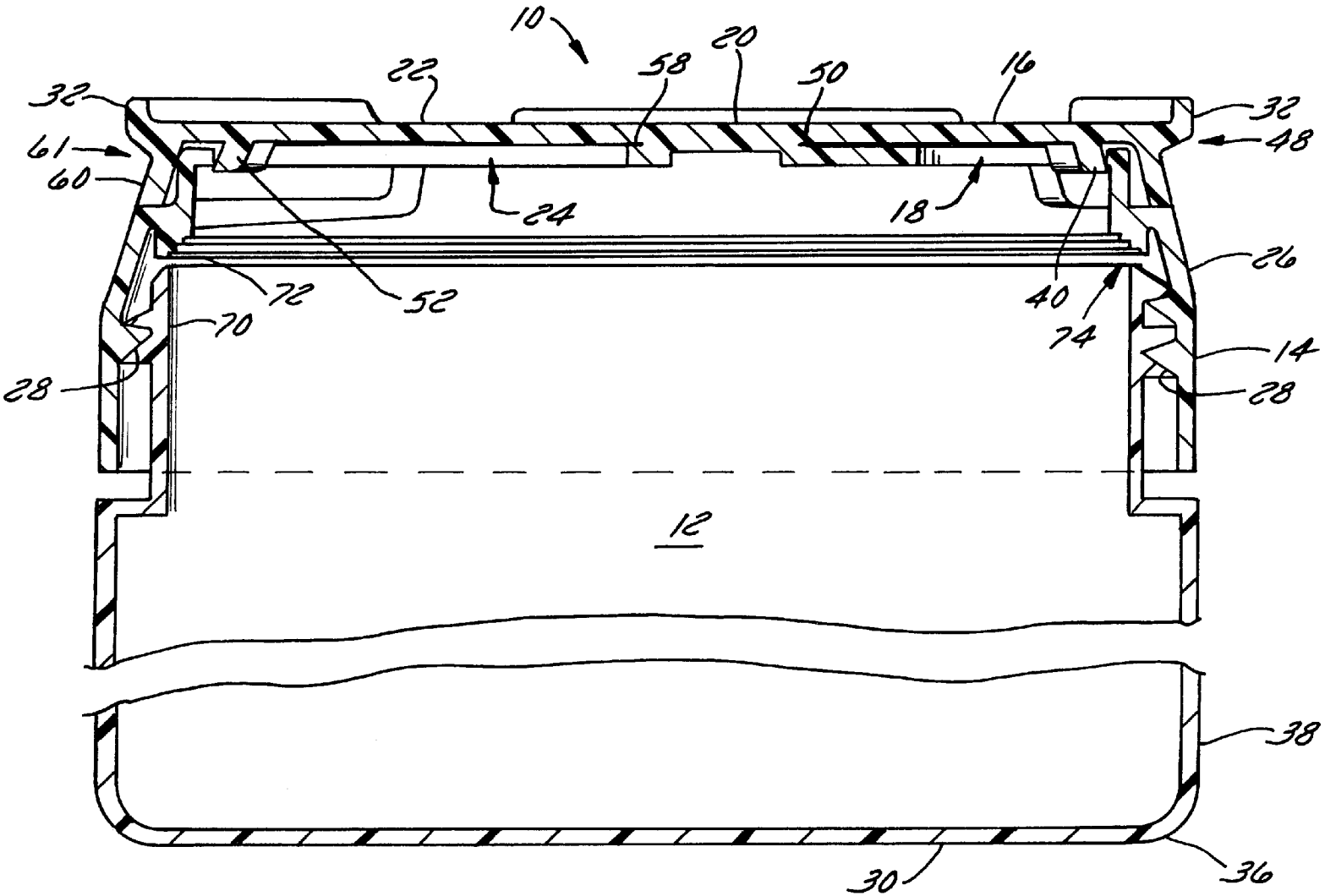
FIG. 3 is a cross-sectional view of the container of FIG. 1 showing the angled orientation of the flap skirts.

FIG. 3 shows cover 14 in cross-section along a diametral line of the cover. The cross section is perpendicular to both the shaker flap hinge 50 and the spooning flap hinge 58. Flange 40 does not extend perpendicularly from the underside of shaker flap 16, but downward and outward at an angle of between 9 and 25 degrees, and more preferably of between 5 and 20 degrees with respect to the longitudinal axis of container 10. This angular relationship is particularly beneficial in that it allows the cover, including the flaps, to be readily and integrally molded as a single monolithic piece. In addition, this angle allows flange 40 to releasably lock into central opening 18 when shaker flap 16 is closed.

Shaker flap 16 also includes a skirt 46 that extends downwardly from shaker flap 16. Skirt 46 is disposed an outer edge of shaker flap 16. Skirt 46 is indented into the cap to provide, together with the outer surface of cylindrical portion 26 a substantially right circular cylindrical wall.

Skirt 46 has an indentation 48 disposed at a central outer portion of skirt 46 and is configured to receive a finger or finger nail of the user. This allows the user to grasp shaker flap 16 and readily open container 10 by lifting upward on the indentation.

Figure 4:
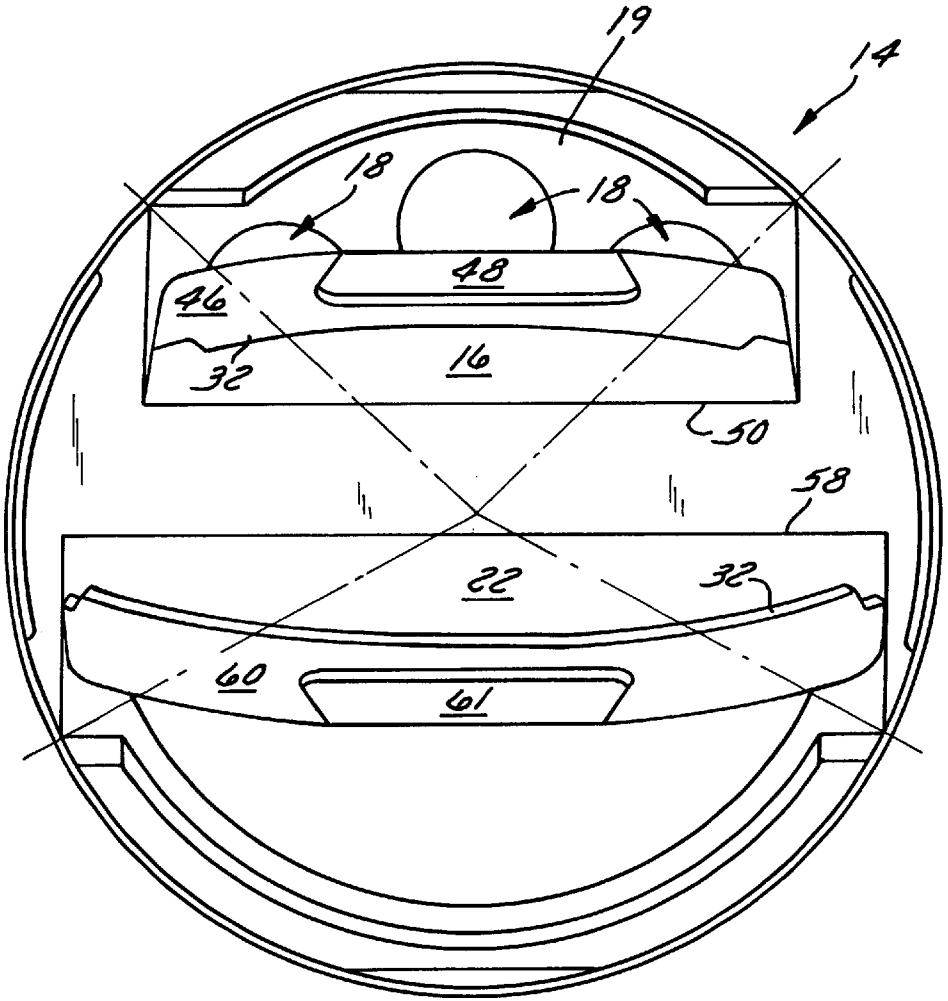
FIG. 4 is a top view of the cover of FIG. 1 with the flaps in an open position.
Figure 5:
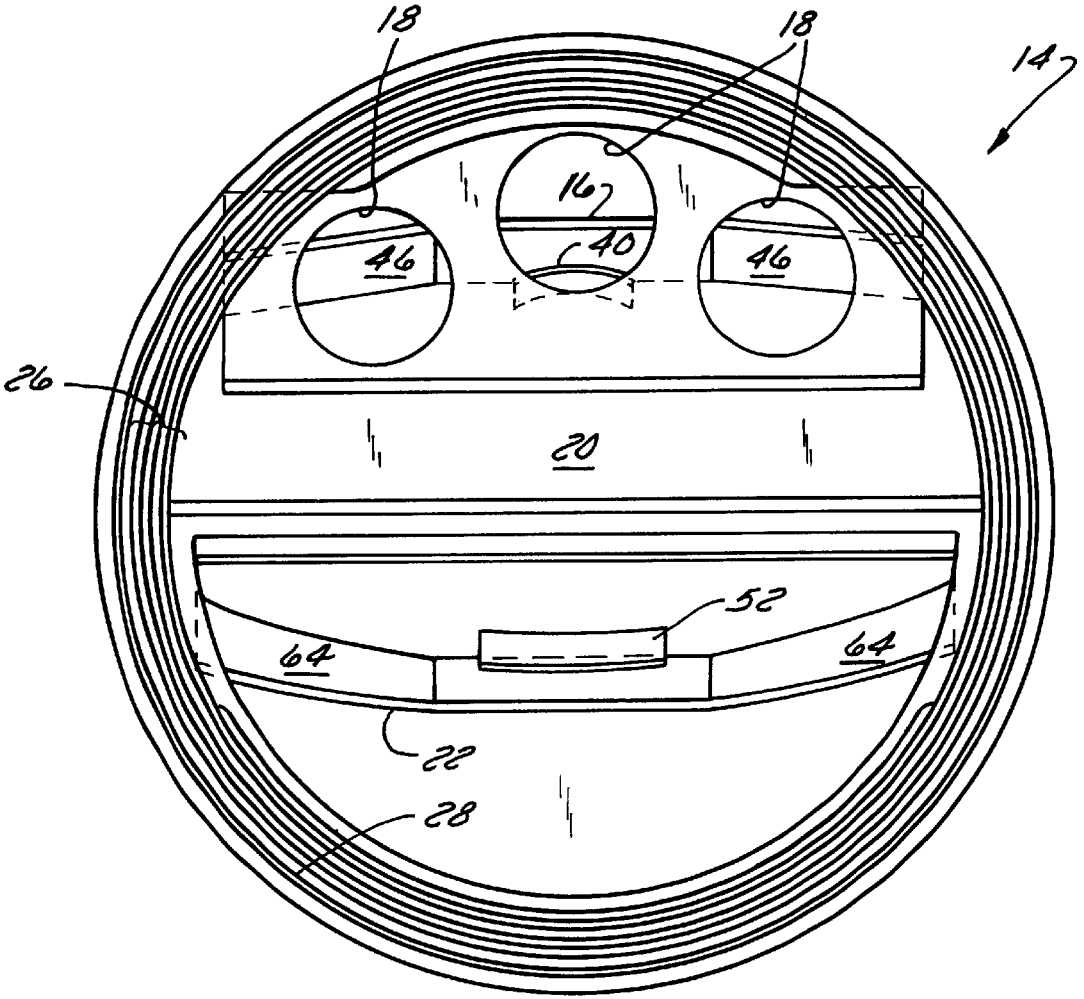
FIG. 5 is a bottom view of the cover showing the circular sealing surfaces.

Skirt 46 preferably extends around cover 14 for an arcuate length of between 60 and 120 degrees (see FIG. 4). From an outward appearance, therefore, skirt 46 would appear to form between 60 and 120 degrees of the circumference of the upper part of cover 14. This provides a significant advantage in the design of cover 14.

Since skirt 46 is arcuate, rather than straight, it is less likely to be bent over when the cover is grasped and opened, and further distributes the grasping load more evenly around the outer edge of shaker flap 16. This allows shaker flap 16 to be made thinner and therefore to require less plastic when manufactured.

Referring to FIG. 3, when the shaker flap 16 is closed, flange 40 engages an outer portion of shaker opening 18 to thereby releasably lock shaker flap 16 to top portion 20 in a closed position. While only a single flange 40 is shown in cross section in FIG. 4, each of the other openings 18 may also have a flange (not shown) to provide additional engagement surfaces and thereby hold the shaker flap closed even better.

Shaker flap 16 is coupled to top portion 20 by a flexible and integrally formed hinge 50 preferably extending the entire length of shaker flap 16.

Spooning flap 22 is coupled to top portion 20 by a flexible and integrally formed hinge 58 preferably extending the entire length of spooning flap 22. Note that, unlike certain prior art covers with hingeable flaps, hinges 50 and 58 are disposed adjacent to a diametral line of cover 14 to allow the flaps to hinge upward and toward the middle of cover 14. In prior art covers, the hinges were formed along an outer edge of the cover, which allowed the flaps to be opened upward and outward. This caused the flap to dangle in its open position. As a result, the flap was often in the way of the material being shaken out of the container, causing the flap to be covered with the foodstuffs or other materials inside.

Spooning flap 22 covers spooning opening 24. Spooning flap 22 has a flange 52 depending from a lower surface of spooning flap 22 that engages and locks against the inside of opening 24. As with flange 40 on the shaker flap, Flange 52 does not extend perpendicularly from the underside of spooning flap 22, but extends at an angle, preferably between 9 and 25 degrees outward and downward away from the underside of the spooning flap.

As with flange 40 of the shaker flap, by disposing flange 52 at this angle, cover 14 can be manufactured in a single piece with spooning flap 22 formed integrally with cover 14. Flange 52 preferably has an arcuate length of between 20 and 180 degrees (shown as 20 degrees here). Over this length, flange 52 engages the inside edge of spooning opening 24 to releasably lock spooning flap 22 to top portion 20 when spooning flap 22 is in a closed position.

Spooning flap 22 also includes a skirt 60 like skirt 46 of the shaker flap. Like skirt 46, skirt 60 extends downwardly from spooning flap 22 near an outer edge of spooning flap 22 and has an arcuate shape to define an outer substantially vertical surface of cover 14 when spooning flap 22 is in a closed position. Skirt 60 has an indentation 61 disposed at a central outer portion of skirt 60 and is configured to receive a finger or fingernail of the user. This allows the user to grasp spooning flap 22 and readily open container 10. Skirt 60 preferably extends around the circumference of cover 14 when in the closed position for an angle pi of between 100 and 150 degrees (see FIG. 4). From an outward appearance, therefore, skirt 60 would appear to form between 100 and 150 degrees of the circumference of the upper part of cover 14. As with skirt 46 of shaker flap 16, since skirt 60 is arcuate, rather than straight, it has greater structural strength and it is less likely to be bent over when its flap is grasped and opened, and further distributes the grasping load more evenly around the outer edge of spooning flap 22. This allows spooning flap 22 to be made thinner and therefore to require less plastic when manufactured. Note that the arcuate length of skirt 60 is preferably greater than the arcuate length of skirt 46. This additional arcuate length of skirt 60 therefore provides additional strength to spooning flap 22 when the user attempts to open spooning flap 22.

A recess 62 is provided in the cylindrical portion of cover 14 to receive skirt 46 of shaker flap 16. By providing recess 62, skirt 46 can be set into an outer surface of cover 14 when shaker flap is closed, thereby reducing the risk that skirt 46 will be accidentally jostled and caught, shaker flap 16 opened and the contents of container 10 spilled. Similarly, a recess 64 is provided in cover 14 on the opposite side of cover 14 from recess 62 to similarly receive skirt 60 of spooning flap 22 for the same reason. The effect of skirts 46 and 60 being recessed is that the skirts form a smooth and contiguous part of the outer surface of the cylindrical portion of cover 14.

The rim 70 of receptacle 12 has an upper sealing surface 72 that abuts sealing ring 74 of the cover when the cover is screwed onto the receptacle. Sealing ring 74 has several separate and distinct sealing surfaces 76. These surfaces are flat and extend normal to the longitudinal axis of the cap. Each sealing surface is separated from adjacent sealing surfaces by cylindrical walls 78 that are circular and parallel to the longitudinal axis of the cap. Each sealing surface defines a plane that is substantially perpendicular to the longitudinal axis of the receptacle and cover. Each of these planes intersects the longitudinal axis at a different point along its length.

The wide sealing surface of the '399 patent discussed briefly in the Background of the Invention is intended to accommodate rather than correct the ovality of the bottle openings. By providing a wide sealing surface, the bottle opening can be quite oval, yet will engage around its entire periphery with the sealing surface, thus providing a good, although oval seal. As we noted above, this may be effective for hand-tightened caps but not for machine-tightened caps. As torque is applied to a cap with an oval bottle opening and bottle sealing surface, the walls of the bottle at its mouth that are distorted inward toward the central axis of the bottle will collapse and be forced inward. In a similar fashion, the walls of the bottle at its mouth that are distorted outward away from the central axis of the bottle, will collapse and be forced outward. Thus, when the cap is over tightened on the bottle, the mouth of an oval bottle becomes even more oval until it finally collapses. In contrast to this, the sealing surfaces of the present invention are designed to prevent the collapse of the bottle's mouth by forcing the mouth of the bottle into a circular shape. Alternatively, the mouth of the bottle becomes ever more oval as the cap is over-torqued onto the bottle. This causes the threads adjacent to the minor axis of the oval bottle mouth to pull away from the mating threads on the caps. This disengagement, in turn, causes the cap to pop off.

The stepped sealing surfaces are preferable to that of the prior art since they force warped, non-circular container mouths into a circular shape as the cap is screwed down, unlike the wide sealing surface of the '399 patent.

Figure 6:
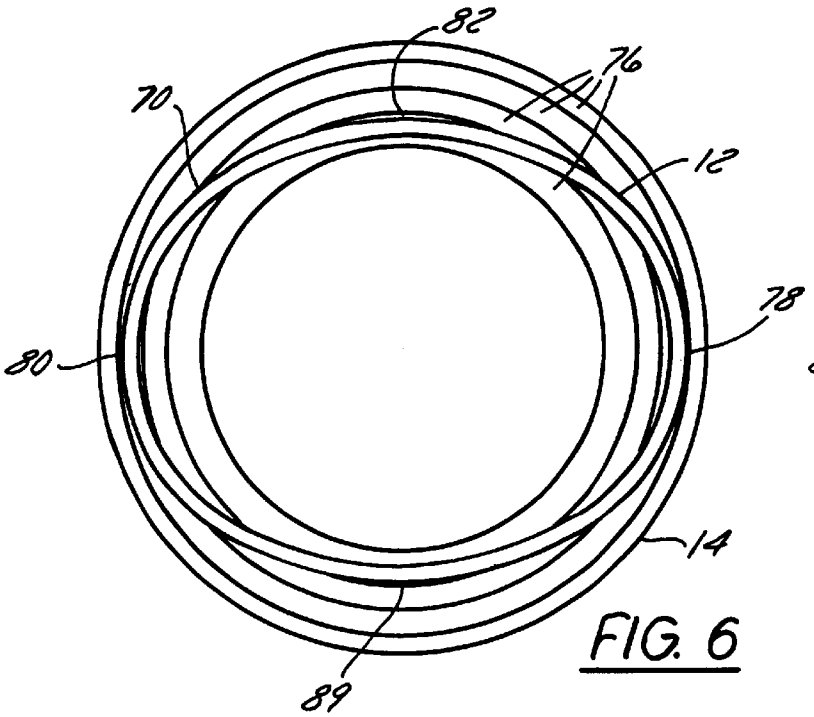
FIG. 6 is a partial plan view of the sealing ring of the cap (not to scale) showing each of the sealing surfaces enlarged in exaggerated form together with the rim of the receptacle, wherein the rim of the receptacle is oval and the rim has just contacted the sealing ring during tightening.
Figure 7:
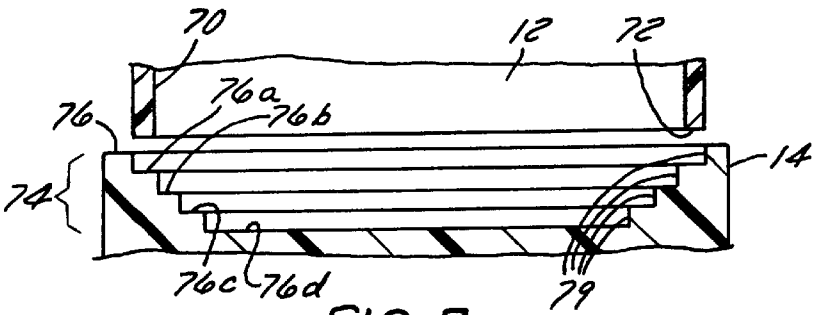
FIG. 7 is a partial cross-sectional side view of the sealing ring and receptacle rim of FIG. 6 in cross-section wherein the cutting plane for the cross section is coplanar with the longitudinal axis of the receptacle and sealing ring.

In FIGS. 6 and 7, a warped bottle with an oval rim 70 and sealing surface 72 of FIGS. 6–7 has just been screwed into cover 14 of FIGS. 6 and 7 by an automatic capping machine. Rim 70 just contacts the outermost sealing surface 76 of cover 14 having the largest inner and outer diameter (a slight gap is shown for convenience). In a typically manufacturing line, the automatic capping machine would rotate the cover until it reached this position, at which a certain (minimal) initial resistance to rotation would exist due to contact at points 78 and 80.

The top of the bottle is in the form of an ellipse or oval and therefore rim 70 has a major axis and a minor axis. The first parts of the bottle sealing surface to contact ring 74 are the portions of the sealing surface at the opposing ends of the major axis. The endpoints 82, 84 of the minor axis of the sealing surface do not even contact the cover, but are suspended in space.

The tightening process does not stop with this initial contact at points 78, 80, however. The torque applied by automatic capping machines has not reached its preset torque limit, and hence continues rotating, tightening the cover even more firmly to the receptacle.

Since there are several independent sealing surfaces 76 on the cap, arranged in a stair step fashion, the bottle contacts the cap initially at only two small points on the rim as shown in FIGS. 6 and 7. As a result of this relatively high load on two small points of rim 70, the capping machine's additional torque causes rim 70 to deflect and bend slightly.

As the cover is further screwed down, endpoints 78, 80 of the major axis of sealing surface 72 are deflected inward under the increasing pressure between the cover and receptacle. Eventually, rim 70 and its sealing surface 72 assume a more circular shape. As the cover is screwed down further, the endpoints 78, 80 of the major axis are pushed inward toward the central axis of the cover and receptacle, and the endpoints 82, 84 of the minor axis are deflected outward, away from the central axis. Eventually, the rim itself is circular enough (i.e. the major axis is small enough) that the rim collapses into the next smaller diameter sealing ring 76.

Figure 8:
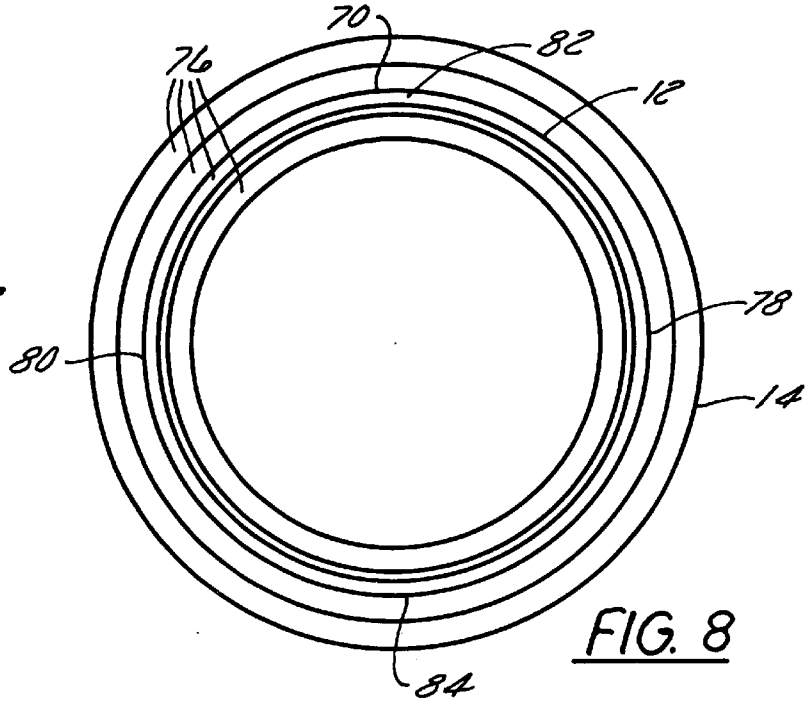
FIG. 8 is a partial plan view of the sealing ring of the cap (not to scale) showing each of the sealing surfaces enlarged in exaggerated form together with the rim of the receptacle as in FIGS. 6 and 7, but after the cap has been tightened and the rim has been drawn down into the sealing ring and the ovality of the rim corrected.
Figure 9:
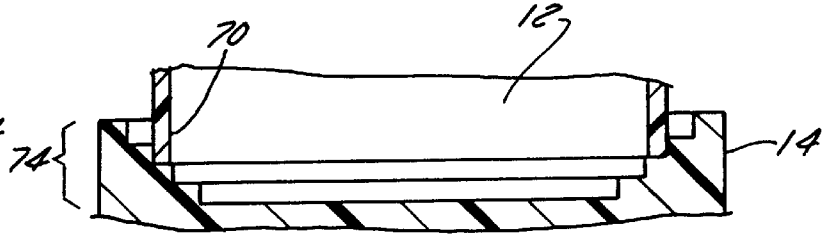
FIG. 9 is a partial cross-sectional side view of the sealing ring and receptacle rim of FIG. 8 wherein the cutting plane of the cross-section is coplanar with the longitudinal axis of the sealing ring and the receptacle; and+

This new position is shown in FIGS. 8 and 9. Note that the rim is more circular, and is completely supported on the next smaller sealing surface 76. Since the diameter of the sealing surface 72 on rim 70 is substantially the same as the diameter of the sealing surface 76 on the cover, the cover cannot be screwed any further onto the receptacle without collapsing or bending the entire rim of the receptacle. As additional torque is applied by the capping machine to rotate the cover onto the receptacle, there is no further collapse of the rim, and the torque rises quite rapidly to the torque limit of the automatic capping machine.

During this final period of rotation, the two abutting sealing surfaces rotate with respect to each other. It is this relative rotation and slippage that applies the additional torque. As a result, the friction between the surfaces is reduced to sliding friction and the rim slides with respect to sealing surface. In the device of the '399 patent, there is nothing to stop the deflection from causing rim 70 to warp into an extremely oval shape. As a result, the threads often pull apart and the cover pops off.

In the present invention, however, there is a mechanism to prevent the additional torque from causing more ovality. The cylindrical wall 79 between sealing surfaces 76*a* and 76*b* of the cover prevents rim 70 from deflecting outward as the final torque is applied. Rim 70 is nested inside this cylindrical surface, and therefore cannot move outward into a more out-of-round condition. If it starts to move outward, it abuts cylindrical surface 79 and stops while it is still substantially circular, and before the threads of the cover and the receptacle pull away from each other and disengage.

Figure 12:
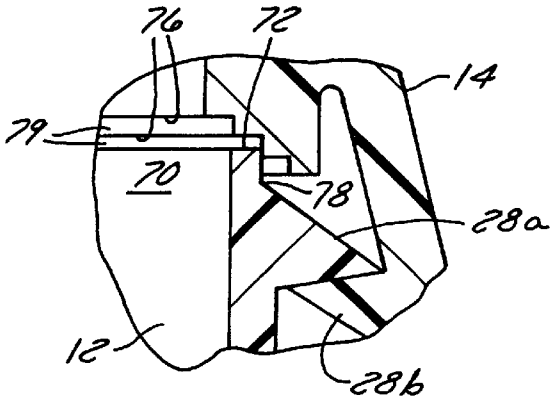
FIGS. 10–12 are fragmentary cross sections of the cover and receptacle along a section line that is planar with the major elliptical axis of the warped receptacle shown in FIGS. 6–9 as the cap is tightened on the receptacle.
Figure 11:
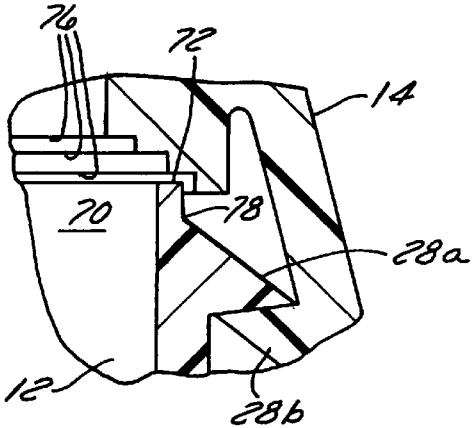
Figure 10:
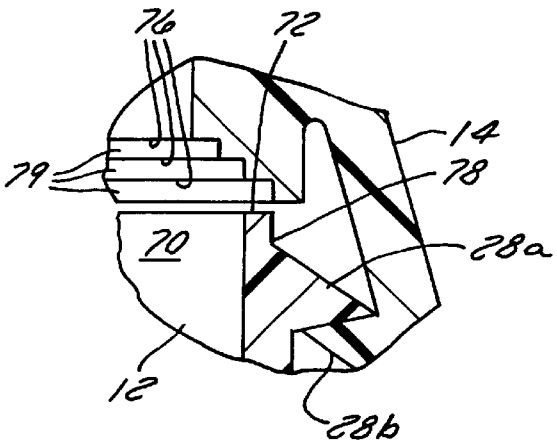

FIGS. 10–12 show how a receptacle rim collapses to a smaller diameter along the major axis of the receptacle's rim. FIG. 10 shows rim 70 as it approaches sealing surface 76 of cover 14. Point 78 is one of the end points on the major diameter of the oval-topped warped receptacle. Threads 28*a* on the receptacle engage threads 28*b* on the cover. As the cover and receptacle are rotated with respect to each other receptacle 12 moves until it is in the position shown in FIG. 11, the second of the three FIGURES. In this position, the rim just contacts the sealing surface 76 (a slight gap is shown to make the drawing easier to understand). As additional torque is applied to the cap, it rotates further until it is in the position of FIG. 12 and point 78 of rim 70 collapses to the next smaller diameter sealing surface 76. Note that the threads 28*a* and 28*b* move slightly apart. At this stage, the entire sealing surface 72 of the rim contacts sealing surface 76 of cover 14 (a slight gap is shown to make the drawing easier to understand). The rim cannot collapse inward any further when additional torque is applied, since the minor axis has increased (as shown in FIGS. 8–9) so that it abuts cylindrical surface 79 between two adjacent sealing surfaces 7*b*.

The FIGURES show how a single receptacle with a single rim diameter is sealed against the cover. The cover is not limited to a single rim diameter, however. Since there are several sealing surfaces on the cover (four of them in the embodiments illustrated herein), each having a slightly smaller diameter, the cover can be screwed onto four different receptacles with four different rim diameters. For each of these receptacles, the operation would be the same as described above: initial contact with a first sealing surface at two points on the major diameter, collapse to the next smaller sealing surface on the cover's sealing ring, and the application of a final tightening torque while the cylindrical surface prevents the rim from deflecting outward. With four different sealing surfaces and three different cylindrical surfaces between them, this cover can accommodate at least three different receptacle rim diameters—three different receptacles. The only difference in operation is that receptacles with smaller rim diameters will rest on sealing surfaces 76 that also have smaller diameters. Receptacles with larger diameter will nest on sealing surfaces 76 with larger diameters.

The system therefore accommodates a variety of receptacle mouth sizes by providing several sealing surfaces against which they can seal. It also corrects the shape of warped bottles used with automatic capping machines by forcing the bottles to collapse inward until the entire sealing surface at the rim of the bottle assumes a circular shape.

Thus, it should be apparent that there has been provided in accordance with the present invention an improved container that fully satisfies the objectives and advantages set forth above. Although the invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A circular plastic cap for a top of a container, the cap having a longitudinal axis, the cap comprising:

a. an end cover;

b. at least one flap integrally formed with the end cover;

c. a cylindrical skirt integrally coupled to the end cover at one end and having a second open end configured to receive the mouth of a receptacle;

d. a thread coupled to an inner surface of the cylindrical skirt; and e. a circular sealing surface disposed inside the skirt and adjacent to the end cover, the sealing surface having a plurality of planar sealing surfaces, axially spaced apart, such that each sealing surface has a greater diameter the closer said each sealing surface is to an end of the skirt, wherein the thread is configured to engage a mating thread on the container and to compress the top of the container against only one of the plurality of planar sealing surfaces when the thread is tightened.

2. The cap of claim 1, wherein each sealing surface has as axial width substantially equal to or less than an average thickness of the cap.

3. The cap of claim 2, wherein the sealing surface includes a plurality of substantially right cylindrical surfaces coaxial with the cap disposed between adjacent sealing surfaces.

4. The cap of claim 3, wherein each right cylindrical surface has a greater diameter than the preceding right cylindrical surface as one approaches the open end of the skirt.

5. The cap of claim 4, wherein the sealing surface is fixed to the end cover.

6. The cap of claim 5, wherein the sealing surface is not fixed to the skirt.

7. A container comprising:

a. a receptacle including a right cylindrical sidewall having an externally threaded upper end and a lower end, a bottom integrally formed with the sidewall and enclosing the lower end of the sidewall, wherein the upper end of the receptacle defines a mouth having a mouth sealing surface; and b. a circular plastic cap having a longitudinal axis, wherein the cap further comprises, i. an end cover;

ii. at least one flap integrally formed with the end cover;

iii. a cylindrical skirt integrally coupled to the end cover at one end and having a second open end configured to receive the mouth of a receptacle, and iv. a circular sealing ring disposed inside the skirt and adjacent to the end cover, the sealing ring having a plurality of planar sealing surfaces, axially spaced apart, such that each sealing surface has a greater diameter the closer that sealing ring is to an end of the skirt, wherein only one of the plurality of sealing surfaces is engaged with the mouth sealing surface and at least one of the plurality of sealing surfaces is not engaged with the mouth sealing surface.

8. The container of claim 7, wherein the end cover and the at least one flap are configured to provide the cap with a substantially flat planar end surface.

9. The container of claim 8, wherein the at least one flap is recessed into and flush with the end cover.

10. The container of claim 9, wherein the cap further comprises:

a. at least a second flap, wherein the second flap is integrally formed with the end cover.

11. The container of claim 10, wherein the second flap is recessed into and flush with the end cover.

12. The container of claim 11, wherein each sealing surface has an axial width substantially equal to or less than an average thickness of the cap.

13. The container of claim 12, wherein the sealing ring includes a plurality of substantially right cylindrical surfaces coaxial with the cap disposed between adjacent sealing surfaces.

14. The container of claim 13, wherein each right cylindrical surface has a greater diameter the preceding right cylindrical surface as one approaches the open end of the skirt.

15. The container of claim 14, wherein the sealing ring is fixed to the end cover.

16. The container of claim 15, wherein the sealing ring is not fixed to the skirt.

* * * * *